United States Patent [19]

Heil

[11] 4,160,883

[45] Jul. 10, 1979

[54] ACOUSTIC TRANSDUCER AND METHOD OF MAKING SAME

[76] Inventor: Oskar Heil, 1775 Parrott Dr., San Mateo, Calif. 94402

[21] Appl. No.: 892,416

[22] Filed: Mar. 31, 1978

[51] Int. Cl.[2] ..... H04R 7/00; H04R 7/16; H04R 31/00

[52] U.S. Cl. ..... 179/114 M; 29/594; 179/181 R; 181/171; 181/173

[58] Field of Search ..... 29/594; 181/157, 161, 181/162, 163, 164, 165, 166, 167, 168, 169, 170, 171, 172, 173, 174; 179/181 R, 181 F, 181 W, 114 M

[56] References Cited

U.S. PATENT DOCUMENTS 1,778,871 10/1930 Smythe ..... 181/161

*Primary Examiner*—George G. Stellar

*Attorney, Agent, or Firm*—Phillips, Moore, Weissenberger, Lempio & Majestic

[57] ABSTRACT

An acoustic transducer comprising a light weight diaphragm is disclosed in which the internal vibrational resonant modes of the diaphragm are prevented or blocked without damping effects by mounting of the diaphragm on a rigid base parallel thereto by means of a multiplicity of similar parallelograms with flexible corners having dynamically rigid sides the lengths of which are a small part of the wavelength therein of the highest frequency acoustic waves to be transduced with no two adjacent parallelograms being spaced from each other by a distance which is more than a small part of the wave length in the diaphragm of the highest frequency acoustic waves to be transduced. Preferred embodiments are described in which the diaphragm is divided into elements by the parallelograms with the individual elements made rigid by means other than the materials used, for example, by providing appropriate shape or tension in such element.

46 Claims, 32 Drawing Figures

ACOUSTIC TRANSDUCER AND METHOD OF MAKING SAME

BACKGROUND OF THE INVENTION

This invention relates to an acoustic transducer which not only reproduces a frequency range of interest, with high fidelity and improved efficiency, but which is also capable of reproducing rapidly varying frequency characteristics with high fidelity.

In the reproduction of tones and sounds it is, of course, necessary that the transducer be capable of reproducing a suitable range of frequencies, but applicant has found that in order to provide improved fidelity, it is also necessary to reproduce without any time lag frequencies which vary rapidly, such as, for example, those which occur at the start and at the end of a note, so that intonations, glissandos and fading notes can be faithfully reproduced, i.e., without any interfering frequencies arising out of the characteristics of the transducer. Until now, little attention has been paid to this problem, as conventional research, conditioned by the instruments used, was mainly restricted to the reproduction as a function of the frequency range. However, the human ear in particular is very sensitive to frequencies which vary over very short intervals and it is precisely such frequency changes that are characteristic features of certain musical instruments, particularly of string instruments and also of the players of such instruments.

Such phenomena which occur for very short time intervals are not well dealt with by conventional acoustic transducers or loudspeakers because the above-mentioned fine detail in lost in the reproduction due to the damping effects conventionally used in the prior art in an attempt to avoid undesirable resonances and distortion.

Acoustic transducers for converting mechanical or electrical energy into sound waves, and vice versa, necessarily include a coupling element or diaphragm which physically moves or is physically moved by the sound propagating medium. In the case of musical instruments, the coupling element may be a sounding board, for example, whereas in the case of loudspeakers, the coupling element is usually a thin light weight body in the form of a sheet or cone. In both cases, the coupling element or diaphragm will have inherent internal structural resonances, which, in the case of musical instruments may not be objectionable because such resonances add the color and quality of tone characteristics of that particular musical instrument.

However, in the case of loudspeakers for converting electrical energy into sound waves and vice versa, any inherent internal structural resonances in the diaphragm will cause distortions and reduce the fidelity of the transducing process. For example, if the diaphragm is made of thin material, the audio frequencies to be transduced will be propagated in the diaphragm itself, tending to cause the diaphragm to be momentarily corrugated. Such corrugations will produce increased rigidity in the diaphragm which will raise other existing resonances to a higher pitch, producing gliding tones which do not exist in the original sound to be transduced.

The above described phenomena is quite complicated and difficult to visualize. It is similar to the basic principles of operation of a well-known pseudo musical instrument commonly called a "singing saw" in which tones of different pitch are produced by varying the rigidity of the saw blade by simply bending it in differing amounts. However, the phenomena is much more complex and more closely resembles the Raman effect found in electromagnetic waves.

In the prior art there has been no attempt to reduce the "singing saw or acoustic Raman" effect because it has not previously been recognized.

Loudspeaker diaphragms are conventionally made of a fibrous material which frictionally resists internal bending forces. In addition, other damping elements are conventionally used which are either mechanically connected to the diaphragm or acoustically coupled to the second produced thereby.

However, damping devices also introduce distortion into the transducing process in addition to reducing the efficiency of the transducing process by absorbing energy therefrom. In other words, damping devices rely on frictional effects to avoid or reduce undesired resonances and such frictional effects are constantly changing in a dynamic system due to the great difference between the frictional forces present when two elements or fibers are at rest with respect to each other and the frictional forces present when they are in motion with respect to each other.

This effect is not limited to fibrous materials but is also present in other damping material such as plastics or rubber having high internal frictional losses. These materials have long chain molecules which take the place of fibers and rub on each other as they move with respect to each other in a dynamic system.

This effect is measurable and is responsible for certain colorations known to be present in all loudspeakers having paper or fibrous diaphragms.

In any event, both the "singing saw" effect and the internal friction effect, described above, reduce the fidelity of the acoustic transducing process.

It is a primary object of this invention to avoid the resonances in the frequency range of the transducers which produce the "singing saw" effect. By avoiding such resonances, the need for damping is eliminated.

SUMMARY OF THE INVENTION

Briefly, a high fidelity acoustic transducer according to this invention comprises a light weight diaphragm in which internal vibrations (i.e., movement of any portion thereof with respect to any other portion) is avoided by positioning the light weight diaphragm in parallel relation to a heavy weight, structurally rigid base and mechanically connecting the diaphragm to the base by dynamically rigid means which define, with the diaphragm and base, a plurality of spaced similar parallelograms with flexible corners. In preferred embodiments, the lengths of the sides of the parallelograms are a small part of the wave length of the highest frequency acoustic waves therein to be transduced and no two adjacent parallelograms are spaced from each other by a distance which is more than a small part of the wave length in the diaphragm of the highest frequency of the frequency range to be transduced.

BRIEF DESCRIPTION OF THE DRAWING

The foregoing and other objects and features of this invention will be more fully understood from the following detailed description when read in conjunction with the accompanying drawing wherein.

DETAILED DESCRIPTION OF PREFERRED EMBODIMENTS

Figure 1:
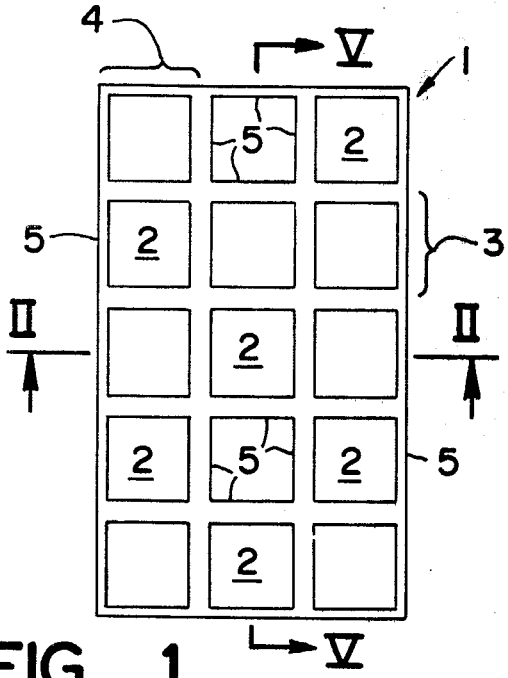
FIG. 1 is a view in elevation of a diaphragm according to one embodiment of this invention.

FIG. 1 shows a diaphragm according to one embodiment of this invention which is divided into individual elements 2, which form rows 3 and columns 4 and as a whole forms a flat rectangle. The elements of the diaphragm are more clearly shown in FIG. 2. They consist of cushion-shaped individual elements which give the element the necessary stiffness where the individual elements are interconnected via connecting seams 5. The elements could have other polygonal configurations.

The diaphragm is constructed from two separate foil membranes which are joined at the seam 5 along edges of the individual elements. The two separate foils are also joined at seams 5 about the outer periphery of the diaphragm 1.

Figure 3:
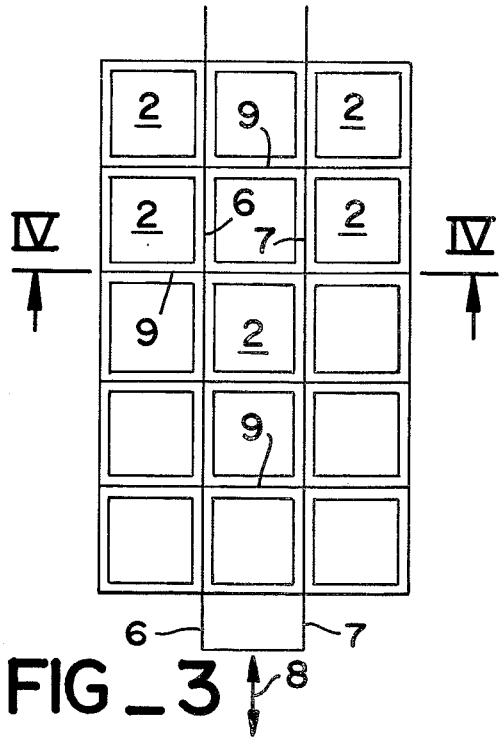
FIG. 3 shows a diaphragm similar to FIG. 1, however, with acoustic conducting elements embedded therein.
Figure 4:
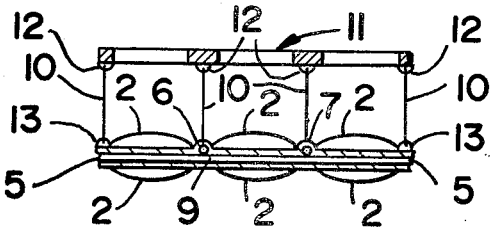
FIG. 4 is a sectional view taken along the line IV—IV of FIG. 3.

FIG. 3 shows an embodiment where acoustic conducting rods are embedded at the seams 5. In this case, the acoustic conducting rods 6 and 7 which run along the longitudinal direction are connected to a drive operating in the direction of the double arrow 8, whereas the acoustic conducting rods 9 along the transverse seams are at right angles to this direction. FIG. 4 shows a very effective way of embedding the acoustic conducting rods, where the rods 6 and 7 are embedded between the semi-circular cross-section ribs of the individual elements 2 which are formed in one foil, while the rods 9 running in a transverse direction are embedded in a similar way in another foil, so that both foils can first be formed separately, for example by vacuum forming and then be welded to form a seam, so that then the acoustic conducting rods running in the longitudinal and transverse direction will not interfere with each other.

The diaphragm could be formed of a single film and may be stiffened by shaping it into a shell or cone shape. The material of the diaphragm may have a high speed sound conducting characteristic, and may be, for example, keflar, polyester, polycarbonate or kapton foil or a metal foil such as aluminum or titanium.

The acoustic conducting elements have a high acoustic speed and could be rods with rectangular, circular, or semi-circular cross-section. A particularly suitable material is a mixture of approximately 60% graphite yarn and 40% epoxy resin.

Figure 2:
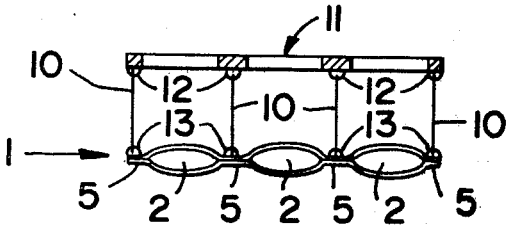
FIG. 2 is a sectional view taken along the line II—II of FIG. 1.
Figure 5:
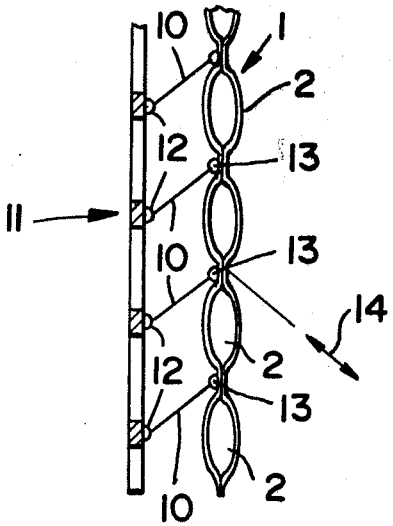
FIG. 5 is a sectional view taken along line V—V of FIG. 1.

FIGS. 2, 4 and 5 show schematic sections of how the diaphragms may be mounted on a base 11 by the pivotal supports 10. These pivotal supports 10 are each connected to a rigid base 11 at one end via a flexible joint 12 and to the diaphragm 1 at their other end via a flexible joint 13. Two adjacent pivotal supports 10 in conjunction with the base 11 and the diaphragm 1 will form a parallelogram. The diaphragm 1 will therefore practically have only one degree of freedom of movement, namely a movement along the section of a circle around the joint 12 with a radius equal to the length of the pivotal support 10. Thus, the diaphragm 1 is fastened to the base and all the individual elements 2 of the diaphragm 1 will inevitably have to perform the same movement.

As shown in FIG. 5, the pivotal supports 10 may form an included angle of approximately 45° with the surface of the diaphragm 1 and the drive from an appropriate motor may, for example, be introduced at a pivot point 13. As shown in FIG. 5, the drive is applied in the direction indicated by the double-headed arrow 14, i.e., approximately in the direction of a tangent of the compulsorily described circular motion of the point 13. The direction of drive of the motor is not restricted to a specific angle; it could also occur in the direction of the diaphragm, as indicated by the double-headed arrow 8 in FIG. 3, or in the direction at right angles to the plane of the diaphragm. However, the component of the drive motion in the direction at right angles to the plane of the diaphragm should be large in comparison to the component of the drive motion in the direction of the plane of the diaphragm to ensure a sufficient efficiency of the loudspeaker. A suitable angle will be when the component of motion at right angles to the surface of the diaphragm is about twice the size of the component in the direction of the diaphragm.

The pivotal supports 10 according to embodiments shown in FIGS. 1–5 are rigid rods, the length and spacing of which are a small part of the wavelength therein of the higher frequency acoustic waves to be transduced. They may be made of the same material as the rods 6 and 7 of FIGS. 3 and 4 and any suitable pivotal or flexible joint may be used at the ends thereof.

There will be losses during the propagation of the acoustic energy, which will result in a weaker acoustic emission, the more remote the input position. This phenomenon can be compensated for by making the angle between the surface formed by the diaphragm and the support elements more acute as the distance of the input position increases and hence will ensure a uniform acoustic emission.

Figure 6:
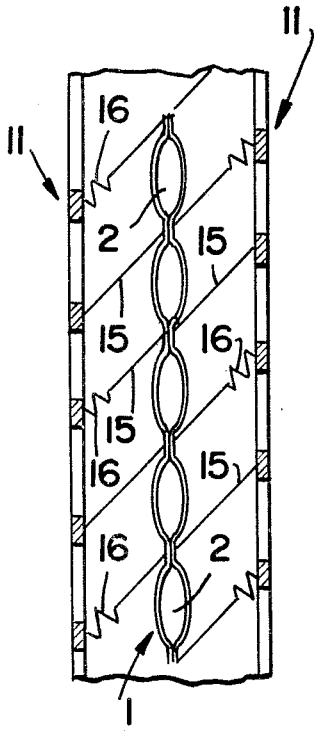
FIG. 6 is a sectional view similar to FIG. 5 but showing another embodiment of this invention.

FIG. 6 shows an embodiment of the invention where the pivotal elements are formed by filaments. Of course, no special joints will be necessary if the filaments are flexible. However, the filaments 15 must be dynamically rigid and thus they are suitably supported on the base via a spring 16, as in this embodiment the diaphragm is supported on both sides. If there are rows of filaments, the spring support can be fitted all on one side or alternately on one side of the diaphragm and then on the other side of the diaphragm for the neighboring filaments.

Figure 7:
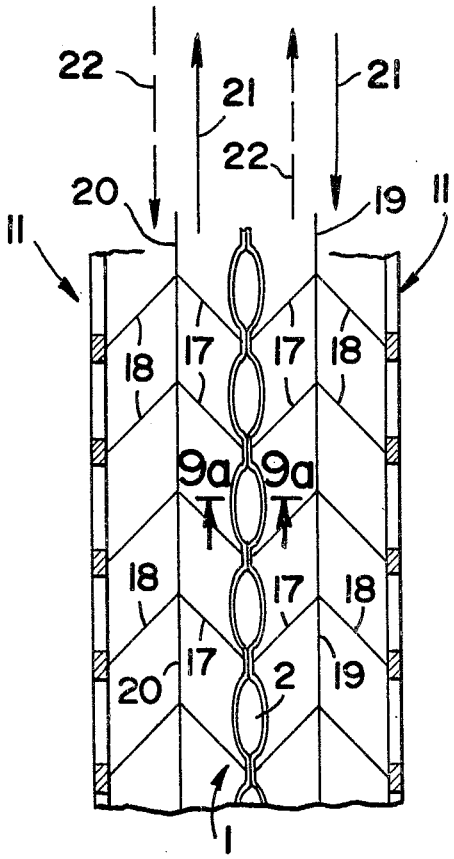
FIG. 7 is a sectional view similar to FIG. 6 but showing yet another embodiment of this invention including a diaphragm which is indirectly supported on two wall sections or bases.

FIG. 7 shows a preferred embodiment of the invention similar to that shown in FIG. 6, where a pair of two rows of support elements 17 and 18 are used to connect both side of the diaphragm 1 to a base 11, not directly, but indirectly via acoustic conducting rods 19 and 20.

Figure 8:
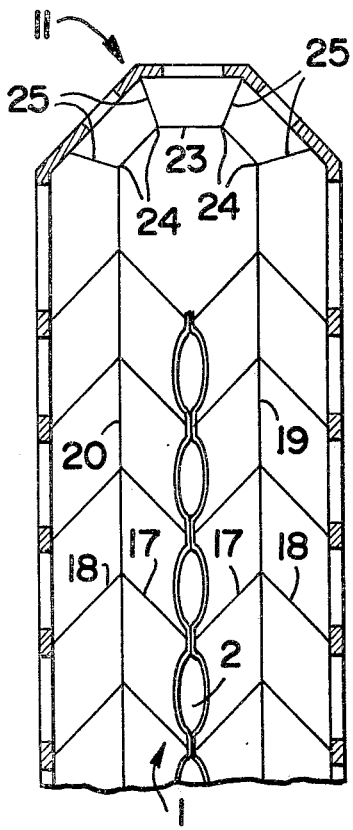
FIG. 8 is a sectional view of an embodiment of this invention similar to the one in FIG. 7, where, however, the acoustic vibrations are transmitted from one acoustic conducting rod to the other conducting rod by a polygonal route.
Figure 9:
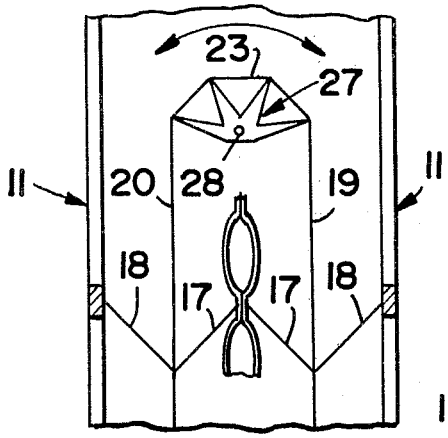
FIG. 9 is a sectional view of an embodiment of this invention similar to FIG. 8, where, however, the tension in the line at the corner is not produced by an external pull, but is supported from the inside.
Figure 9A:
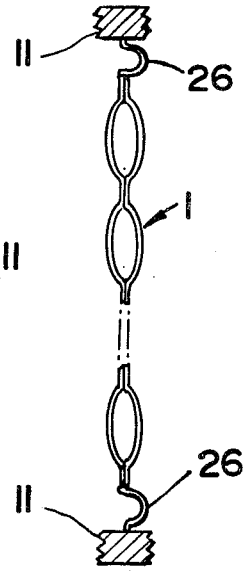
FIG. 9*a* is a sectional view of the diaphragm only taken along line 9*a*—9*a* of FIG. 7 showing the side support of the diaphragm.

The support elements connected to the diaphragm make an acute angle with the diaphragm and are approximately perpendicular to each other. As is shown in FIG. 7, the diaphragm will be pulled to the left when the two acoustic conducting rods 19 and 20 move in the opposing directions indicated by the full arrows 21. The included angle formed by the support elements, in this case filaments, with the acoustic conducting rod 20 will become more acute, while the included angle made with the other acoustic conducting rod 19 will become more obtuse. When the movement is reversed, the two acoustic conducting rods will move in the opposite direction shown by the dotted arrows 22, and the movement of the diaphragm in the drawing will then be to the right. It will be possible to drive the two acoustic conducting rods 19 and 20 separately. However, a single drive can also suffice, as is shown in FIG. 8. Two acoustic conducting rods adjacent the same end of the diaphragm are interconnected via a link strand 23 with a polygonal path. The strand 23 is supported by support elements 25 bisecting the angles in the corners 24 of the polygon, which support elements 25 are, in turn, attached to the base 11, which in this case is taken around the entire diaphragm. It will also be possible for this connecting strand 23 to be supported from the inside instead of from the outside, for example, by a support system 27 as shown in FIG. 9. This support system pivots around the point 28. Contrary to the design according to FIG. 8, where a stable neutral position is guaranteed by means of the supports 25, the embodiment according to FIG. 9 has no stable neutral position.

In the embodiment of this invention shown in FIG. 7, the diaphragm 1 will not be urged to move in its own plane in the directions of the arrows 21 and 22. Instead, the diaphragm will tend to move in directions perpendicular to its surfaces. Thus, as shown in FIG. *9a*, the sides of the diaphragm are preferably mounted to the base 11 by means of flexible mounting members 26.

Figure 10:
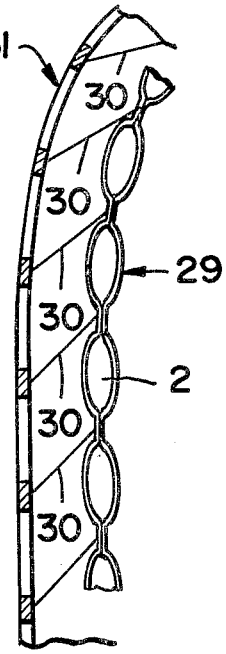
FIG. 10 is a sectional view of an embodiment of this invention similar to FIG. 5 but having a curved diaphragm.

In the above described embodiments, the diaphragm is shown as a flat surface. However, in principle, it is also possible for the diaphragm to have a curved surface. Such a diaphragm 29 (FIG. 10) will then be held by supports 30 to a base 31 with a path which follows that of the diaphragm.

As shown in FIGS. 6–9, the diaphragm will have to be supported on both sides under tension if the filaments are to be dynamically rigid enough to be used as pivotal supports, as the filaments are only capable of absorbing tensile stresses. It will be understood that filaments could be substituted for the drive rods used in embodiments of this invention (for example, drive rods 19 and 20 of FIGS. 7–9) if such filaments are under tension in use to make them dynamically rigid.

Figure 11:
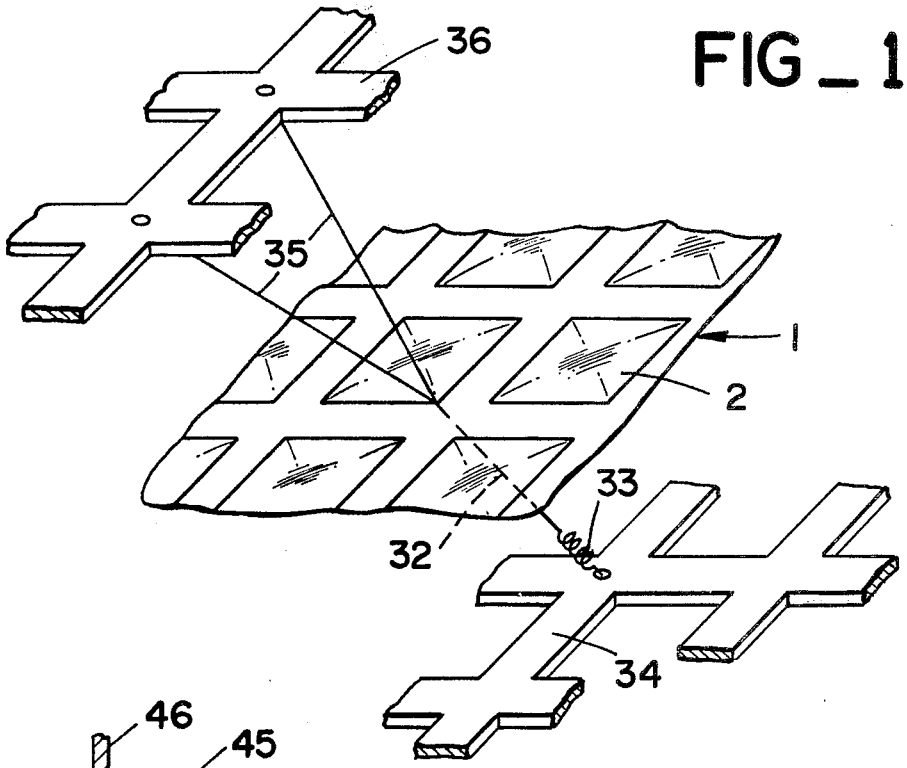
FIG. 11 is a fragmentary perspective view of an embodiment of this invention similar to FIG. 6 showing a filament support for preventing the generation of undesirable transverse oscillations.

By itself it would be possible for the end of a filamentary pivotal support attached to the diaphragm to move along a spherical surface. However, this movement facility will in practice be of hardly any significance for the reasons stated above. Undesirable transverse vibrations can be eliminated with certainty by replacing the single filament shown in FIG. 6 by double filaments inclined at an angle to each other as is shown in FIG. 11. In this example a diaphragm 1 is supported on one side on a base 34 by a single filament 32 via a spring 33 and on the other side to a base 36 via two filaments 35. The plane in which the two filaments are located is at right angles to the vibrations of the diaphragm 31. The transverse vibrations will in this way be neutralized.

Figure 12:
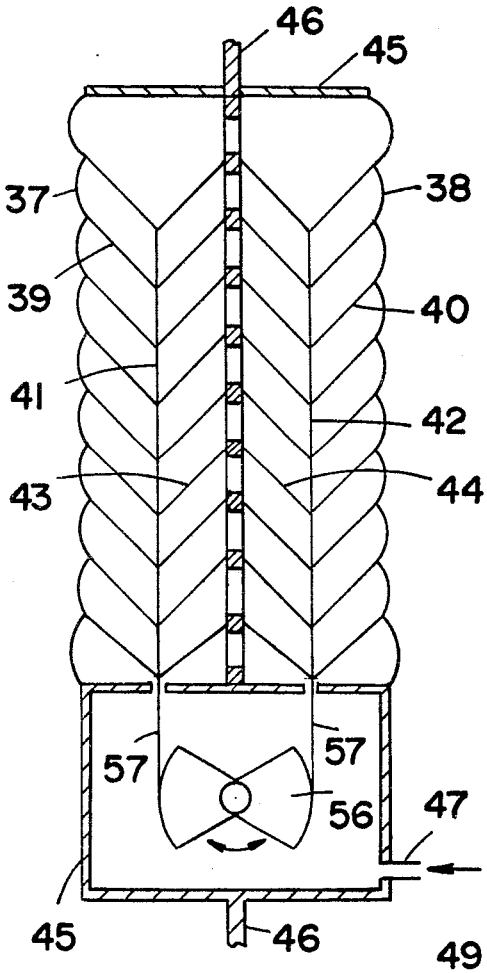
FIG. 12 is a sectional view of a loudspeaker embodying this invention with diaphragms subjected to pressure on one side.
Figure 14:
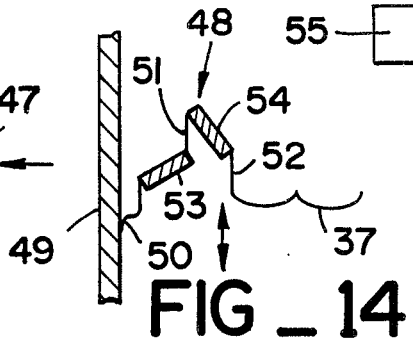
FIG. 14 is an enlarged fragmentary sectional view showing a joint at the edge of the diaphragm of FIG. 13.
Figure 13:
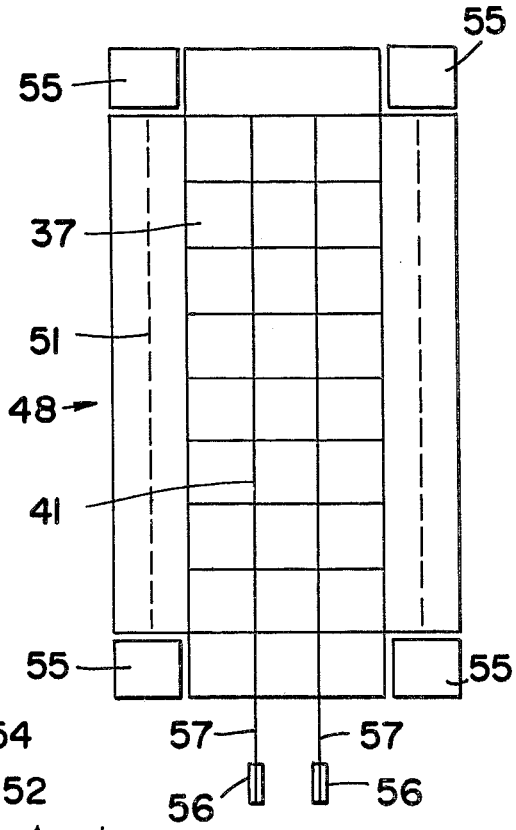
FIG. 13 is a front view in elevation of the diaphragm of the embodiment of this invention shown in FIG. 12.

FIG. 12 shows a section of a loudspeaker with two diaphragms 37 and 38 radiating in opposite directions. The diaphragms are held by rows of support filaments 39 and 40, which in turn are attached to acoustic conducting rods 41 and 42. Further rows of support elements 43 and 44 lead from these acoustic conducting rods to an acoustically transparent base 11 which extends between top and bottom solid plates 45 connected to a baffle 46 outside of the loudspeaker. As the diaphragms in this embodiment are only held on one side by rows of filaments 39 and 40, and these filaments must be made dynamically rigid by subjecting them to tensile stresses, it will require another force to press the diaphragm outwards. This force is produced by air blown into the orifice 47 as indicated by the arrow. Naturally, the housing should be mainly airtight, and this is achieved by attaching the diaphragms 37 and 38 to the plates 45 and by providing the diaphragms 37 and 38 with border strips 48 (as is shown in FIGS. 13 and 14) which are attached on one side to closure plates 49 fixed to the housing and have an airtight connection to the diaphragm on the other side. The elements of the diaphragms 37 (38) have a half-shell section.

The border strips 48 are made flexible in order that the amplitude of the loudspeaker diaphragm can become larger as is clearly shown in the section in FIG. 14. The border strip 48 with a central hinge 51 is coupled to the plate 49 via a folded foil 50 and is connected to the diaphragm 37 at the end 52. The border strip can be reinforced at the positions 53 and 54 between the joints 50 and 51 and 52. There are blocks 55 fitted at the four corners of the assumed rectangular diaphragm 37, leaving a narrow air gap between these blocks and the border strips. The quantity of air escaping from this air gap is so small, that it is easily replaced by the air blown in at orifice 47, so that the excess pressure in the loudspeaker chamber will be guaranteed. Such air gaps, which in principle can run along the entire edge of the diaphragm 37, 38 are constructed such that the width of the air gap will remain unchanged when there is a movement of the diaphragm 37, 38 or the edge of the diaphragm. The inside side walls of such block 55 are in fact perpendicular to the plane of the diaphragm. However, this arrangement is not obligatory and in many cases it can be practical for the boundary walls to be designed in such a way that the air gap becomes wider when the diaphragm is moved outward. The amount of air escaping because of the wider deflection of the diaphragm is greater and reinforces by air stream modulation the sound emitted.

Figure 15:
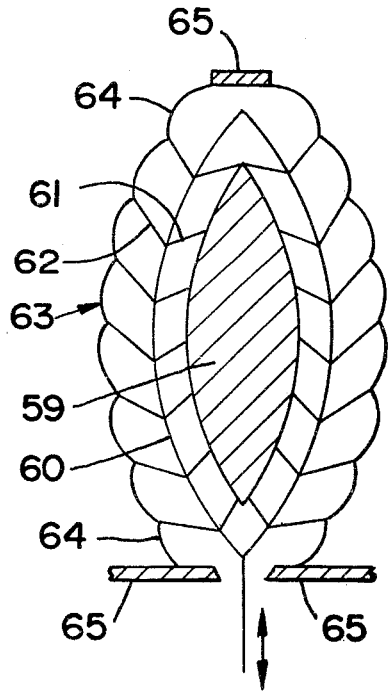
FIG. 15 is a sectional view showing a variation of the shape of the loudspeaker of FIG. 12.

The drive is only shown schematically in FIGS. 12 and 13, and the drive arms 56 can in principle be set into oscillation by any magnetic system, where the vibrations are transmitted to acoustic conducting rods 41 and 42 via a pulling line 57. FIG. 15 shows an embodiment which is similar in principle to the embodiment of FIG. 12; however, in this case, the middle body 59 is approximately lenticular, and the acoustic conducting rods 60 have a similar shape and are connected to the diaphragm 63 via a system of filaments 61 and 62. The diaphragm 63 is connected to rigid supports 65 via hinged joints 64. It will be necessary for the side edges of the diaphragm to be positioned close to the walls of the housing leaving a narrow air gap. The side edges of the diaphragm 63 can be assumed to run parallel in front and in back of the plane of the section shown in FIG. 15. In contrast to other embodiments of this invention, the diaphragm 63 of this embodiment makes a pulsating motion and it is only suitable for medium and high frequencies.

Figure 16:
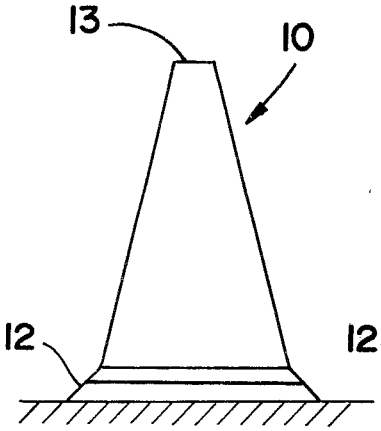
FIG. 16 is a view in elevation of a triangular hollow support element.
Figure 17:
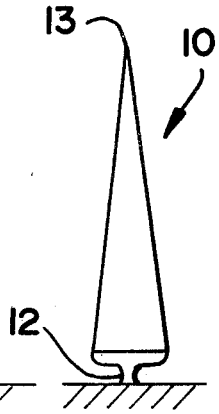
FIG. 17 is a side view in elevation of the support element of FIG. 16.

FIG. 16 shows a front view of a pivotal support element 10 which has the shape of a triangle and which can be subjected to tensile as well as compressive stresses. The apex of this hollow triangular element is attached to the diaphragm via a pivot 13 and to the base via a longer pivot 12. The mass of such a hollow pivotal support element is naturally greater than the mass of a filament; however, not the whole greater mass has an effect, as the support element tapers toward the diaphragm, and furthermore, because a larger amplitude of the motion will only occur at the tapered section, so that the loading produced by the mass of such a support element will be acceptable. FIG. 17 shows a side view of such hollow element.

Figure 18:
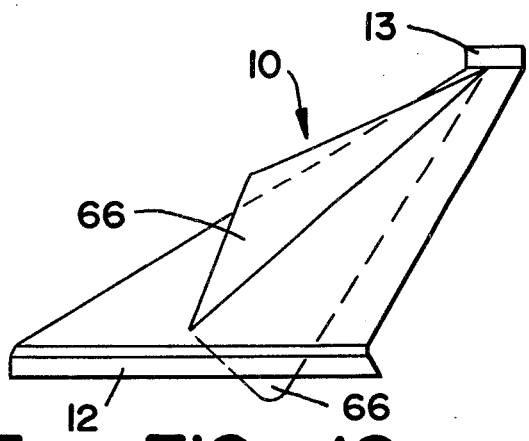
FIG. 18 is a perspective view of a leaf-shaped support element with reinforcement.

The support element in FIG. 18 is similar in principle to the one in FIG. 17; however, there will be a triangular foil 66 reinforcement on each side in place of the hollow section, with the foil fitted at an angle. The connection to the diaphragm is made via a pivot 13 and to the base via another pivot 12.

Figure 19:
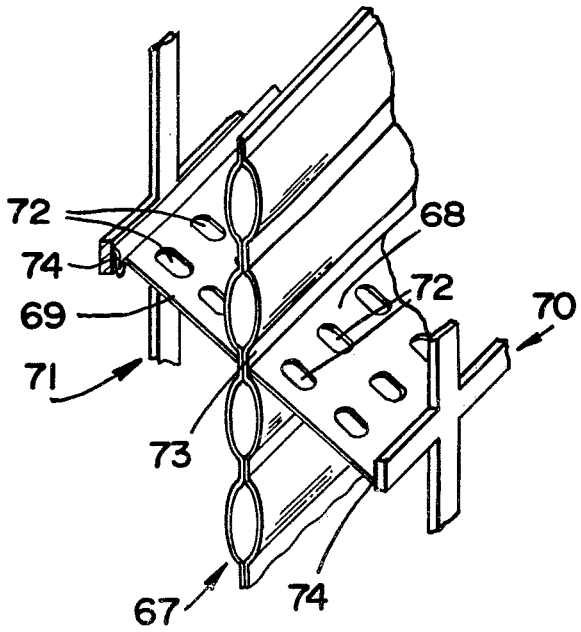
FIG. 19 is a fragmentary perspective view showing the use of foils as support elements.
Figure 19A:
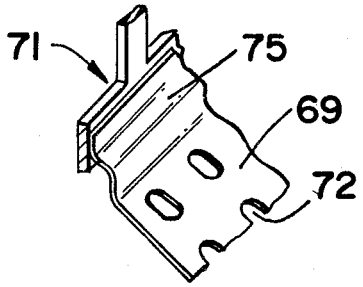
FIGS. 19*a* and 19*b* are enlarged fragmentary perspective views showing forms of pivotal and elastic connections.
Figure 19B:
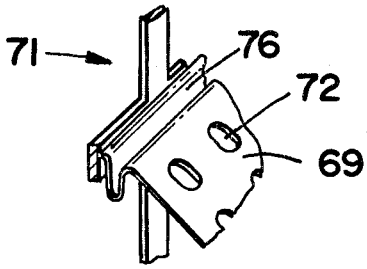

FIG. 19 shows a completely different form of the construction of such a pivotal support element. In this case, a diaphragm 67 is supported on both sides on acoustically transparent base members 70 and 71, respectively, via foils 68 and 69. These foils, which can be provided with holes 72 to achieve a better sound transmission, have one edge 73 attached to the diaphragm 67 and the opposite edge 74 attached to the base members 70 and 71. The attachment to the base should in this case be via resilient devices under tension, as is shown in FIGS. 19*a* and 19*b*. Such a device can consist of a simple bend 75 (see FIG. 19*a*) or a multiple fold 76 (see FIG. 19*b*). The support elements 68, 69 could be formed of fabric.

The support elements 68, 69 could also be formed as rows of small tubes crimped flat at the ends to form pivots at these positions.

Figure 20:
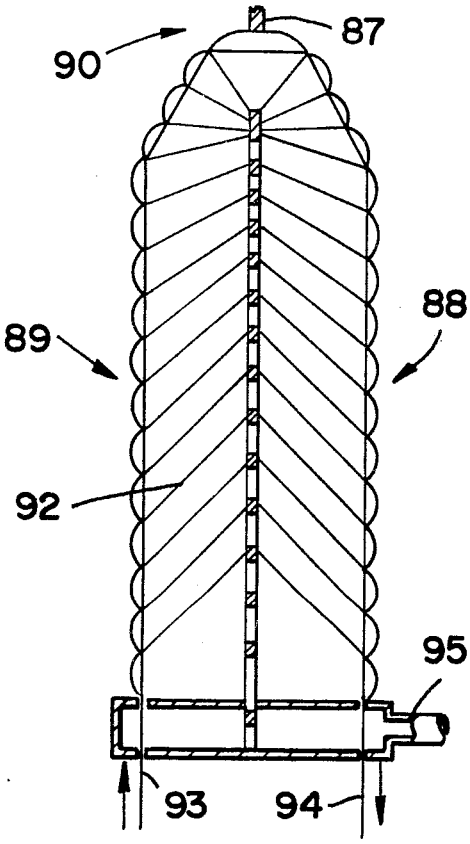
FIG. 20 is a schematic representation of a loudspeaker based on the embodiment of FIG. 3 but with two parallel inflated diaphragm sections linked by a curved section.

FIG. 20 shows a loudspeaker with a diaphragm made from two foil sections 88 and 89 which are joined via a curved piece 90 which is fixed to a baffle 87. A rigid base 91 to which the support elements 92 are attached is fitted along the central plane between the foil sections 88 and 89. The base 91 is perforated, so that the air enclosed in the diaphragm will have free passage. The drive of the diaphragm will be transmitted via acoustic conducting rods 93 and 94, which are driven in an opposite sense, so that a downward movement of the acoustic conducting rod 94 means an upward movement of the acoustic conducting rod 93. When a diaphragm section is moved downwards by the acoustic conducting rod, the distance between the diaphragm section and the base will be reduced, while the distance of the other diaphragm section from the base will be increased. The volume of air enclosed by the diaphragm will therefore produce a reciprocating motion on the inside of the loudspeaker. In this embodiment, the tension in the diaphragm is produced by an excess pressure which is generated by an air pump (not shown in the drawing) connected to orifice 95.

Figure 21:
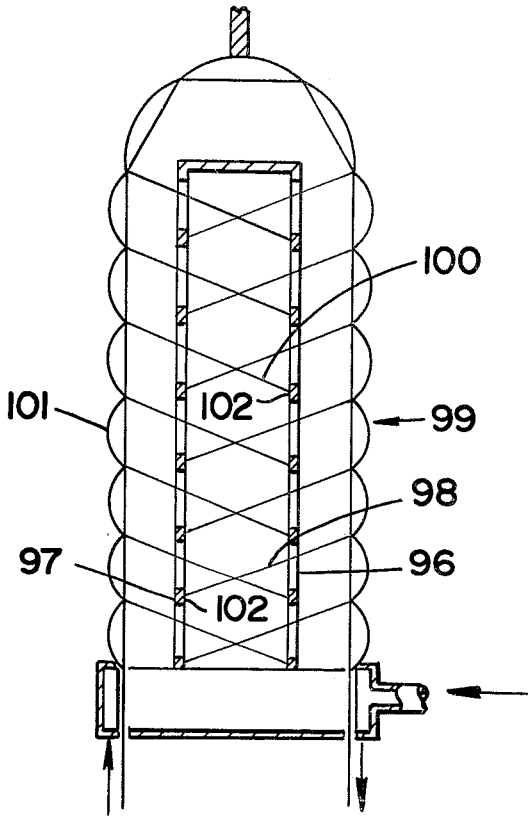
FIG. 21 is a schematic representation of a loudspeaker similar to that of FIG. 20 but with two internal bases.

FIG. 21 corresponds mainly to the embodiment of FIG. 20. However, the base in this case is constructed differently. It consists mainly of two perforated baseplates 96 and 97, with the support elements 98 of the diaphragm section 99 attached to the baseplate 97, while the support elements 100 of the diaphragm section 101 are attached to the baseplate 96, e.g., at 102. In this case, the support elements 98 are fed through the baseplate 96, such that no contact will be made with this plate, even when the deflections of the support element are made larger by larger sound amplitudes. As compared to the embodiment of FIG. 20, the embodiment of FIG. 21 has the advantages of being thinner and having smaller air volume enclosed by the diaphragm.

Figure 22:
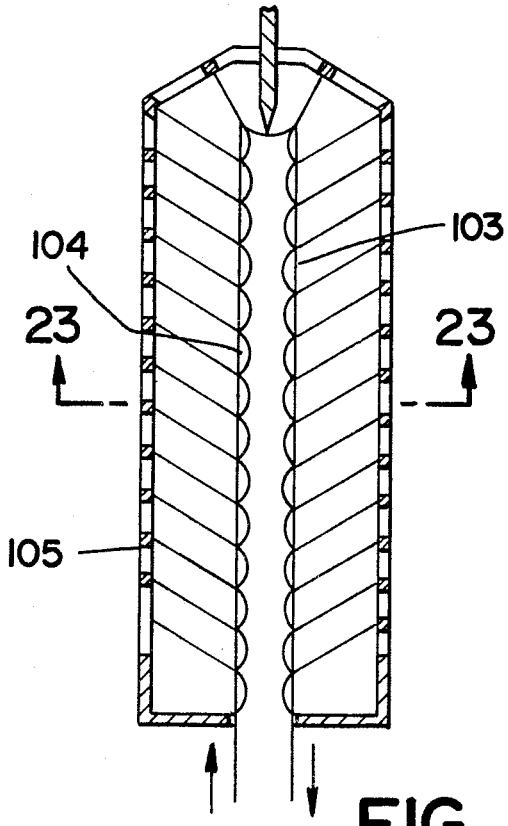
FIG. 22 is a schematic representation of a loudspeaker similar to the embodiment of FIG. 1 with two internal diaphragms and a base surrounding these diaphragms like a casing.
Figure 23:
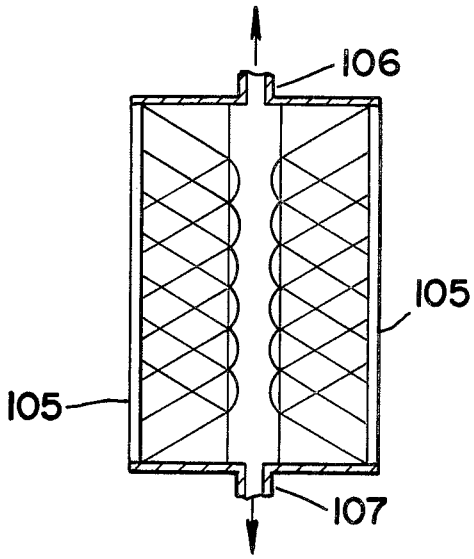
FIG. 23 is a sectional view taken along the line 23—23 of FIG. 22.

The embodiment of FIG. 22 is particularly effective, because in this case the delicate diaphragm foils 103 and 104 are located on the inside of a chamber-like base 105 with perforations to provide passages for the sound. In this embodiment, the tension in the diaphragm foils 103 and 104 is produced by a pressure reduction between the two diaphragm foils. It is evident from the section shown in FIG. 23 that the reduced pressure is applied along the entire length of the edges of the foil sections 103 and 104. The connecting pipes 106 and 107 are linked to a pump (not shown).

Another economic and weight saving way to stiffen the diaphragm between the supporting legs or filaments is to double-corrugate it (as is frequently done in making light weight floor structures in steel buildings). The diaphragm is bent alternately up and down at a 45° angle, producing adjacent strips which extend perpendicularly to each other and thus reinforce each other. The strips themselves are again corrugated perpendicular to their length dimension, producing crosswise corrugations which may have a sine wave conformation, for example. The inclined supporting legs or strips are then arranged as linear extensions of one parallel set of the strips formed by the first corrugations. This offers convenient gluing surfaces of filamentary supports in particular. The diaphragm may be made of a polycarbonate material, such as that sold by General Electric under the name "LEXAN", with particular advantage.

Figure 24:
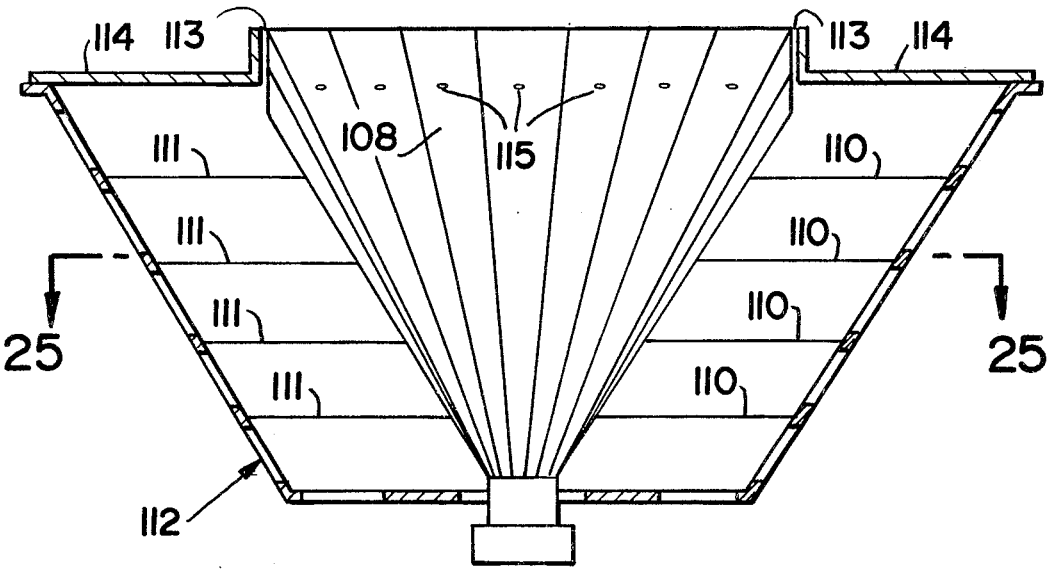
FIG. 24 is a cross-sectional view of a cone type loudspeaker embodying this invention.
Figure 25:
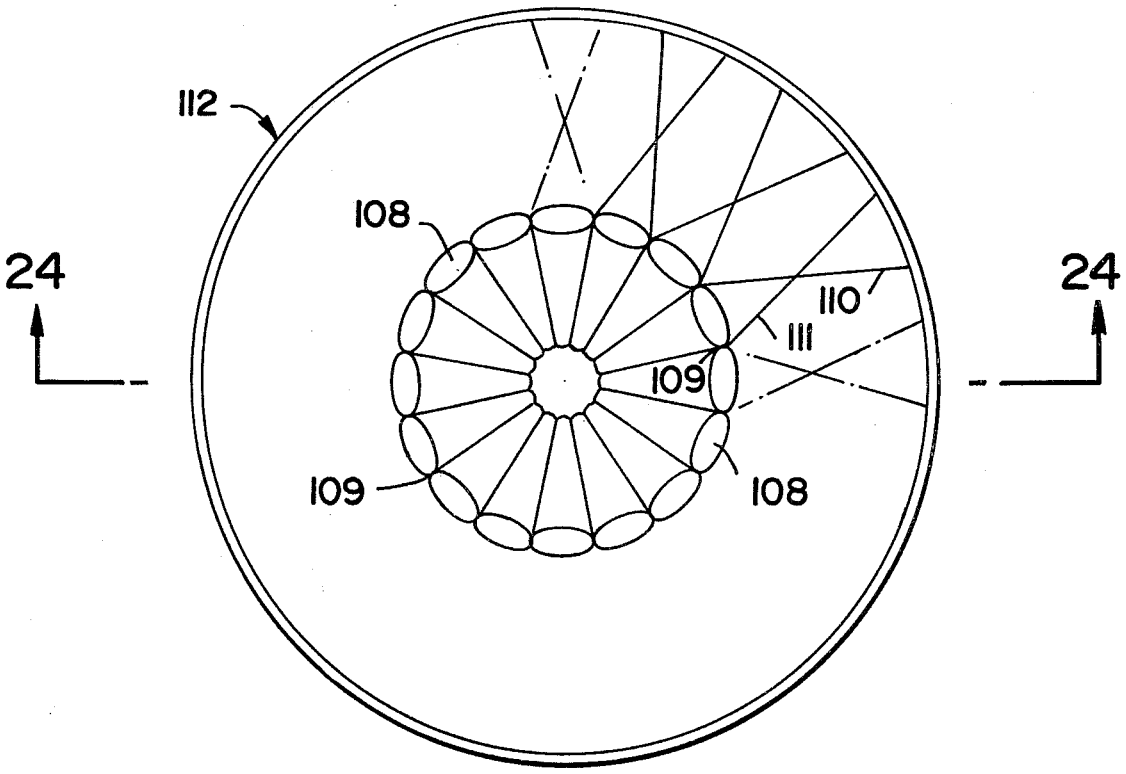
FIG. 25 is a sectional view taken along the line 25—25 of FIG. 24.

FIGS. 24 and 25 show a cone loudspeaker. The diaphragm is divided into a large number of cone-shaped individual elements 108, of which a longitudinal section is shown in FIG. 24 and a transverse section in FIG. 25. These individual elements again form a cone, with the energy of the sound being directed into the apex. The individual elements are enclosed and form cone-shaped elements filled with air thereby providing the outer surfaces of the elements with sufficient rigidity. The support is such that two support filaments 110 and 111 are attached to the connecting line 109 between each two such individual elements, with the free ends anchored to a rigid housing 112 that is parallel to the cone formed by the elements 108 and perforated to make it acoustically transparent. These support filaments are applied in several layers as is evident from FIG. 24. The outer edge of the loudspeaker cone has a circular air gap 113 bounded by a sound screening, ring-shaped plate or baffle 114, which, in turn, is attached to the outer edge of the housing. The cone will become elastically expanded by a slight amount uniformly along its axis when sound is introduced at the apex of the loudspeaker cone causing it to move up or down from its equilibrium position, which produces an additional elastic force due to the compression of the individual elements which are built up like air cushions. These individual elements can be provided with holes 115 which will ensure a pressure equilibrium. The size of the hole will determine the time constant of the air cushion, which can be chosen large enough for the elasticity to remain practically constant right down to the lowest frequencies. The elastic restoring force will be reduced for low frequencies if the holes are greater, so that the resonance frequency will be reduced, and furthermore, there will also be damping and widening due to air friction in the holes. The loudspeaker described here has the advantage that the whole diaphragm can be used properly, so that there will be no need for centering devices and it will not be necessary for the outer edge of the cone to be mechanically connected to the housing. In order to increase the stability, the filament pair 110, 111 which run at an angle, can be directed in such a way that the filaments moving away from the edge of one of the individual elements will cross the filaments leaving the adjacent edge. The planes of the pairs of filaments are perpendicular to the axis of the cone.

For the higher frequency range, the cone type loudspeaker is preferably modified by using a converging cone structure rather than a diverging cone structure as described above. Thus, the moving coil would drive the outer edge of the cone at its largest end with the apex of the cone received within the rigid housing. In all other respects, the structural considerations and elements would be the same as for the diverging cone structure. This embodiment has the advantage that the housing would protect the delicate cone element from damage.

Figure 26:
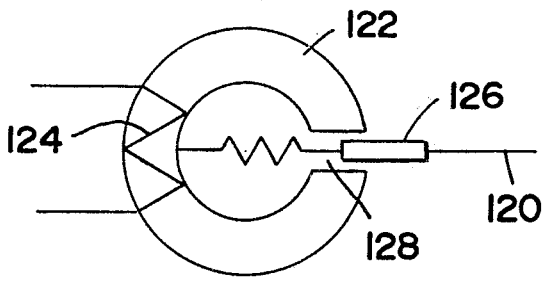
FIG. 26 is a schematic representation of a magnetic drive suitable for use in embodiments of this invention.

Although in principle any conventional drive can be used to drive an acoustic transducer according to this invention, nevertheless there are still certain types of drives which are particularly suitable for the loudspeaker according to the invention. FIG. 26 shows an example of one such drive, which is very suitable if it is desired to cause a rod-shaped acoustic conducting element 120 to oscillate. This drive consists of a magnetic core 122 which is excited by a coil 124 and which has a samarium cobalt disc 126 inserted in the gap. In the rest position, this samarium cobalt disc will extend partly into the magnetic gap 128 between the poles, so that it can be pulled further into the space on excitation.

Figure 27:
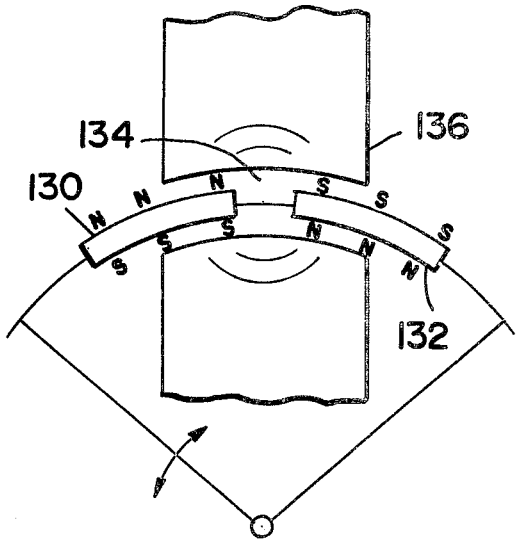
FIG. 27 is a schematic representation of a magnetic drive with rotatably mounted permanent magnet suitable for use in embodiments of this invention.

FIG. 27 shows a modified embodiment. Two permanent magnetic discs 130 and 132, each of which only partly extends into an arcuate gap 134 in a magnet core 136, are pivoted in such a way as to perform pendulum swings. The discs will be magnetized in such a way that they will experience a pulse in the same direction due to the magnetic field and that one will be pulled into the gap while the other is pushed out of the gap.

Figure 28:
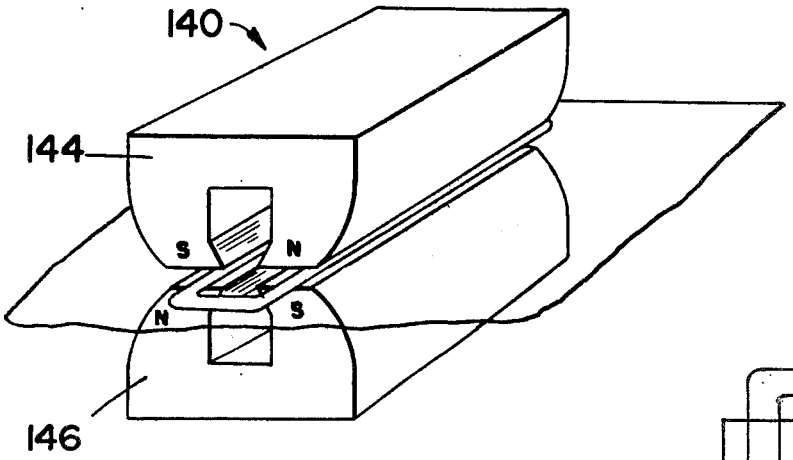
FIG. 28 is a schematic representation of a double magnet drive suitable for use in embodiments of this invention.
Figure 29:
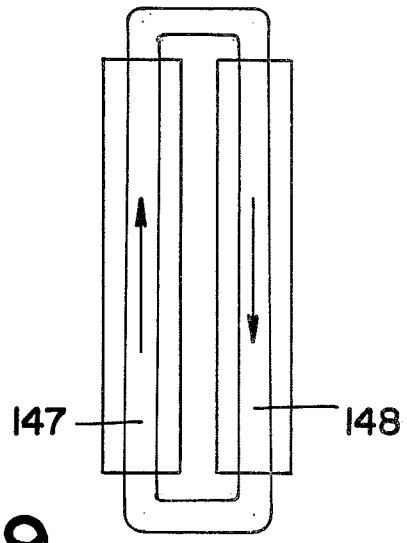
FIG. 29 shows the shape of the coil associated with the drive of FIG. 28.

Another form of drive is shown in FIGS. 28 and 29. FIG. 28 shows a perspective drawing of a motor 140 which drives a flat coil 142. The motor consists in principle of two facing horseshoe magnets 144 and 146, with the opposite poles in each case placed opposite each other. A flat coil 142 is pushed into the space between the poles, to position itself as is shown in FIG. 28. As indicated in FIG. 29, the magnetic field in the gap 147 is in the opposite direction to the magnetic field in the gap 148, and the current in the magnetic coil 142 in both gaps is also in the opposite direction. Thus, a movement pulse will be exerted on the coil in the same direction in both gaps. The efficiency of this drive is particularly high as the magnetic losses due to stray magnetic fields will be exceptionally small.

What is claimed is:

1. The method of making an acoustic transducer comprising the steps of:

(a) fabricating a light weight diaphragm;

(b) fabricating a heavy weight, structurally rigid base defining a supporting surface coextensive with said diaphragm and positioning said diaphragm in parallel relation to said supporting surface of said base;

(c) mechanically connecting said diaphragm to said base by dynamically rigid means defining with said diaphragm and said base a plurality of similar parallelograms with flexible corners, and (d) mechanically connecting a drive means to said diaphragm.

2. The method of claim 1 including the step of arranging said plurality of similar parallelograms in a plurality of mutually parallel planes.

3. The method of claim 1 including the step of arranging said plurality of similar parallelograms defined by said dynamically rigid means with said diaphragm and said base in an array comprising a plurality of mutually perpendicular rows and columns of parallelograms which divide said diaphragm into a plurality of individual elements.

4. The method of claim 1 including the step of dimensioning said plurality of similar parallelograms so that the sides thereof have lengths which are a small part of the wavelength therein of the highest frequency to be transduced by said acoustic transducer.

5. The method of claim 4 including the step of arranging said plurality of similar parallelograms so that no two adjacent parallelograms are spaced from each other by a distance which is more than a small part of the wavelength in the diaphragm of the highest frequency to be transduced by said acoustic transducer.

6. The method of claim 1 including the step of fabricating said diaphragm for defining a plurality of individual stiff diaphragm portions connected to each other by relatively flexible diaphragm portions.

7. An acoustic transducer comprising:

(a) light weight diaphragm means;

(b) heavy weight, structurally rigid base means defining a supporting surface parallel to and coextensive with said diaphragm;

(c) dynamically rigid means mechanically connecting said diaphragm to said base to define with said diaphragm and said base a plurality of similar parallelograms with flexible corners; and (d) drive means mechanically connected to said diaphragm means.

8. An acoustic transducer as claimed in claim 7 wherein said plurality of similar parallelograms are arranged in a plurality of mutually parallel planes.

9. An acoustic transducer as claimed in claim 7 wherein the sides of each of said plurality of similar parallelograms have lengths which are a small part of the wavelength therein of the highest frequency to be transduced by said acoustic transducer.

10. An acoustic transducer as claimed in claim 9 wherein said plurality of similar parallelograms are positioned so that no two adjacent parallelograms are spaced from each other by a distance which is more than a small part of the wavelength in the diaphragm of the highest frequency to be transduced by said acoustic transducer.

11. An acoustic transducer as claimed in claim 7 comprising a loudspeaker, said diaphragm of said loudspeaker defining a plurality of individual stiff elements connected to each other by relatively flexible diaphragm portions and said dynamically rigid means comprising a plurality of support elements on said base, each support element being connected by at least one pivotal connection to the diaphragm and to the base and forming an acute angle with the diaphragm.

12. A loudspeaker as claimed in claim 11, wherein the stiffness of the individual elements of the diaphragm is achieved by means of shaping said individual elements to provide a structurally rigid surface.

13. A loudspeaker as claimed in claim 12, wherein said individual stiff elements defined by said diaphragm are shell-shaped.

14. A loudspeaker as claimed in claim 12, wherein the stiffness of the individual elements of the diaphragm is achieved by a gas pressure exerted on one side of said diaphragm.

15. A loudspeaker as claimed in claim 14, wherein said gas pressure exerted on one side of said diaphragm is above atmospheric pressure and the other side of said diaphragm is exposed to the atmosphere.

16. A loudspeaker as claimed in claim 14, wherein said gas pressure exerted on said one side of said diaphragm is below atmospheric and the other side of said diaphragm is exposed to the atmosphere.

17. A loudspeaker as claimed in claim 12, wherein said diaphragm comprises two foils joined together at the edges of said individual elements, to form cushions each enclosing a volume of gas.

18. A loudspeaker as claimed in claim 17, wherein said base defines a hollow cone shape, said cushions are cone-shaped and said cone-shaped cushions are arranged to define a cone-shaped shell within said base and with said support elements connected between the outside of said cone-shaped shell and the inside of said base.

19. A loudspeaker as claimed in claim 18, wherein said support elements each consist of two filaments attached to said diaphragm at a common point and extending at an angle with respect to each other with the free ends thereof attached to said base, wherein the plane subtended by such filaments is at right angles to the axis of the cone-shaped shell.

20. A loudspeaker as claimed in claim 11, comprising two bases disposed a distance apart between two diaphragms and wherein said support elements are in each case attached to the more remote base from the diaphragm to be supported and extend through the other base to the diaphragm to be supported without touching said other base.

21. A loudspeaker as claimed in claim 11, comprising two of said diaphragms arranged a distance apart with said rigid base located between them.

22. A loudspeaker as claimed in claim 16, comprising two of said diaphragms positioned a small distance apart with said gas at less than atmospheric pressure therebetween and comprising two external, rigid sound transmitting bases on opposite sides of said diaphragm with each diaphragm supported on a different one of said bases by a plurality of said support elements.

23. A loudspeaker as claimed in claim 11, wherein said individual elements defined by said diaphragm are arranged in parallel rows and in columns perpendicular to these rows and have a polygonal contour.

24. A loudspeaker as claimed in claim 11, wherein said diaphragm is made of a material having a high sound speed.

25. A loudspeaker as claimed in claim 24, wherein said diaphragm is made of keflar.

26. A loudspeaker as claimed in claim 24, wherein said diaphragm is made of a foil material selected from the group consisting of polycarbonate, polyester, kapton, aluminum and titanium.

27. A loudspeaker as claimed in claim 11, wherein said support elements form an angle of 45° with said diaphragm.

28. A loudspeaker as claimed in claim 11, wherein the angle formed by said support elements with said diaphragm decreases from support element to support element more remote from said drive means.

29. A loudspeaker as claimed in claim 11, wherein said rigid base means defines a supporting surface parallel to each side of said diaphragm and said support elements consist of filaments which are attached to and run from one supporting surface of the base to the diaphragm at an angle, are attached to it and then from there are directed in the same direction to an attachment to the other supporting surface of the base, said attachment of said filaments to said base comprising spring means.

30. A loudspeaker as claimed in claim 29, wherein the filaments are attached via springs alternately to said one supporting surface and then to said other supporting surface of said base for consecutive filaments.

31. A loudspeaker as claimed in claim 29 wherein two filaments are used for each support element on at least one side of said diaphragm and form an angle with each other, where the apex of the angle is attached to the diaphragm.

32. A loudspeaker as claimed in claim 11, wherein the support elements each comprise a rigid rod.

33. A loudspeaker as claimed in claim 11, wherein the support elements have the shape of isosceles triangles with a small base, where the apex of the triangle is pivotally coupled to the diaphragm and the base of the triangle is pivotally coupled to the base.

34. A loudspeaker as claimed in claim 11, wherein the support elements are formed by foils which are perforated and which are each connected to the base along one side and to the diaphragm along the other side between a different pair of adjacent individual stiff elements thereof.

35. A loudspeaker as claimed in claim 29, wherein the filamentary support elements are formed by pieces of fabric which are connected to the diaphragm on one side and to the base on the other side.

36. A loudspeaker as claimed in claim 11, wherein acoustic conducting elements are embedded in the diaphragm between the individual elements, and consist of a material with a high acoustic speed.

37. A loudspeaker as claimed in claim 36, wherein the acoustic conducting elements are rods with rectangular, circular or semi-circular cross-sections.

38. A loudspeaker as claimed in claim 37, wherein the material used for these acoustic conducting elements consists of a mixture of approximately 60% graphite and 40% epoxy resin.

39. A loudspeaker as claimed in claim 11 wherein support elements are provided on both sides of the diaphragm, said base defines a supporting surface parallel to each side of said diaphragm, acoustic conducting elements are provided between each side of the diaphragm and the supporting surface of the base parallel thereto, the support elements on each side of the diaphragm are each connected to an acoustic conducting element associated therewith, and the acoustic conducting elements are in turn connected to the supporting surface of the base associated therewith via support elements which extend at right angles to the support elements attached to the diaphragm.

40. A loudspeaker as claimed in claim 39 wherein the acoustic conducting elements comprise acoustic rods with the ends of the acoustic rods on the two sides of the diaphragm interconnected via a polygonal link where the link is held at the corners of the polygon by support elements which bisect the angle of the link in each case.

41. A loudspeaker as claimed in claim 39, wherein the acoustic conducting elements comprise acoustic rods with the ends of acoustic rods at the opposite sides of the diaphragm connected to each other via a pivoting element.

42. A loudspeaker as claimed in claim 11 wherein said rigid base is enclosed by said diaphragm with an opening at one end only.

43. A loudspeaker as claimed in claim 7, wherein said drive means drives said diaphragm in a direction which forms an acute angle with the surface of the diaphragm and with a component of motion at right angles to the surface of the diaphragm at least equal to the component of motion along the surface of the diaphragm.

44. A loudspeaker as in claim 43, wherein the direction of drive is in a direction substantially perpendicular to the surfaces of the diaphragm.

45. A loudspeaker as claimed in claim 11, wherein said drive means comprises an electrical drive which consists of a coil-excited magnet with an air gap, wherein the armature consists of a permanent magnet which extends in part into the magnetic field of said air gap.

46. A loudspeaker as claimed in claim 45, wherein the drive means comprises an electrical drive at two opposite ends of the diaphragm, which operate on the diaphragm in opposite sense to each other.

* * * * *

UNITED STATES PATENT OFFICE

CERTIFICATE OF CORRECTION

Patent No. 4,160,883 Dated July 10, 1979

Inventor(s) OSKAR HEIL

It is certified that error appears in the above-identified patent and that said Letters Patent are hereby corrected as shown below:

Column 1, line 34 - change "in" to --is--.

Column 2, line 14 - delete "second" and substitute --sound-- therefor.

Column 4, line 29 - change "seam" to --seams--.

Column 9, line 22 - delete "of" and substitute --for-- therefor.

Column 10, line 26 - before "extend" insert --only--.

Column 12, line 2 - after "on" insert --said--.

Signed and Sealed this

*Thirtieth* Day of *October 1979*

[SEAL]

*Attest:*

RUTH C. MASON
*Attesting Officer*

LUTRELLE F. PARKER
*Acting Commissioner of Patents and Trademarks*